United States Patent [19]

Novak et al.

[11] Patent Number: 4,503,891

[45] Date of Patent: Mar. 12, 1985

[54] LOOM

[75] Inventors: Jiri Novak; Jan Pjgrt; Jan Bezdicek; Milan Fenik, all of Brno; Vladimir Kuda, Blazovice; Vladimir Vasicek, Moravsky Krumlov, all of Czechoslovakia

[73] Assignee: ZVS Vyzkumnevyvojovy ustav koncernova ucelova organizace, Brno, Czechoslovakia

[21] Appl. No.: 352,377

[22] Filed: Feb. 25, 1982

[30] Foreign Application Priority Data

Mar. 2, 1981 [CS] Czechoslovakia ..... 1452-81

[51] Int. Cl.[3] ..... D03D 47/00

[52] U.S. Cl. ..... 139/116; 139/1 E; 139/435; 139/450; 139/370.2

[58] Field of Search ..... 139/1 R, 1 E, 116, 117, 139/118, 429, 435, 450, 370.2

[56] References Cited

U.S. PATENT DOCUMENTS

| | | | |
|---|---|---|---|
| 3,705,607 | 12/1972 | Tollison et al. | 139/116 |
| 4,102,362 | 7/1978 | Tojo . | |
| 4,398,568 | 8/1983 | Rydborn | 139/1 E |

FOREIGN PATENT DOCUMENTS

| | | | |
|---|---|---|---|
| 2935507 | 3/1981 | Fed. Rep. of Germany | 139/1 E |
| 0006668 | 1/1957 | Japan | 139/435 |

*Primary Examiner*—Henry S. Jaudon

[57] ABSTRACT

A loom having a means for automatically unweaving the weft upon the occurrence of a weaving fault, thereby reducing the labor needed to overcome such weaving fault and thus increasing the efficiency of the loom. The apparatus includes a device for the selective prevention of the weft from entering the shed of the loom, said device being mounted on the loom between the weft supply and the weft-entering end of the shed. The invention may be applied to looms wherein measured lengths of weft are inserted mechanically into the shed, or to jet looms, wherein measured lengths of weft are inserted by jets of inserting fluid such as air or water into the shed of the loom.

2 Claims, 5 Drawing Figures

LOOM

The present invention relates to a loom, said loom being provided with means for the selective prevention of the introduction of a further weft thread into the shed upon the determination of a weaving fault. The most frequent cause of weaving faults is a weft or a warp defect. A weft defect may be a break in the weft, which happens very rarely, and imperfect pick, i.e., a short pick or by the tangling of the weft which forms a loop therein.

When such defects occur, looms, particularly jet looms, are stopped in the quickest possible way. However, in view of the present increase of weaving speeds, and thus also the number of rpm's of the loom, it is impossible to stop the loom instantaneously due to the great inertial force of the moving parts thereof. Thus, in spite of the weft defect, a weft pick is performed and at least one weft is woven-in after the occurrence of the weft defect.

Modern jet looms are provided with electronic controls, which minimize manual intervention by the loom attendants, and thus also the time losses which effect the output of the loom. Upon weaving-in a further weft, the machine cannot be fully automatized in unweaving the faulty weft. Consequently, the attendants must take out the last inserted weft upon the stoppage of the machine with the parts thereof in their proper position for so doing. The loom is then reversed by means of the electric motor drive which is controlled by pertinent control buttons, to bring the loom back for one revolution into the shed with the faulty weft. After taking out the faulty weft, it is necessary to return the loom into a position with a finished weft insertion, which is suitable for the restarting of the operation of the loom. This operation is tedious for the attendants, and the losses caused by interrupting the operation cannot be decreased. Moreover, upon the quickest possible stoppage of the loom, the parts of the loom become more rapidly fatigued and worn due to the action of great kinematic and imertial forces thereon.

In accordance with the prior art, it is possible to solve the problem of preventing weaving-in of a further weft due to a weaving fault without the necessity of the immediate stoppage of the whole loom. It is possible to stop the weft measurer of suitable design in such manner that the further weft pick already measured thereon is not withdrawn therefrom by the weft inserting means. Another prior method consists in stopping the weft inserting means, e.g. by preventing the pressure fluid from entering the main nozzle of jet looms.

The disadvantages of the prior art as discussed above are mitigated by the loom according to the present invention. In accordance with the invention, between the weft supply and the weft-entering end of the shed there is disposed means for the selective prevention of weft insertion into the shed by deflecting the further weft to be inserted into the shed from the normal inserting direction thereof in such manner that the further weft misses the shed.

Preferred embodiments of apparatus in accordance with the invention for preventing the weaving-in of a further weft upon the occurrence of a weaving fault are illustrated in the accompanying drawings, where:

Figure 1:
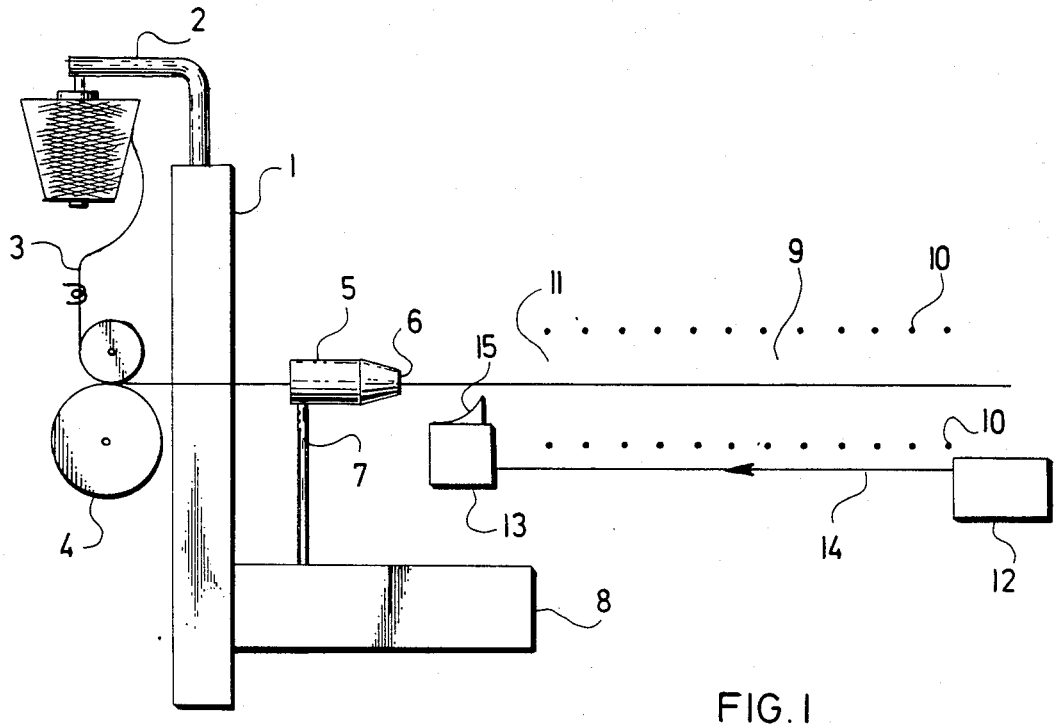
FIG. 1 is a schematic view in side elevation of the general arrangement of the apparatus of the invention.

Turning first to FIG. 1, a device 2 for supporting a weft thread supply 3 is mounted on the frame 1 of a loom. Weft 3 is fed to a measurer 4 and from the measurer to an inserting device which is formed by a main jet nozzle 5 with an outlet 6. Nozzle 5 is connected to a pressure fluid source 8 through a conduit 7 which is connected to the nozzle. The loom has a shed 9 located downstream of the outlet 6 of the main nozzle 5, shed 9 being formed by upper and lower warp threads 10 and having an inlet end 11 adjacent the outlet 6 of the nozzle 5. The loom is provided with a checking device 12 which contains sensors (not shown) for indicating a weaving fault. The output of checking device 12 is connected by a line 14 to the input of a means 13 for the selective prevention of weft 3 from entering into the shed 9. Means 13 is mounted between main nozzle 5 and the inlet side 11 of the shed in such manner that the stop means incorporated in the weft deflector 13 when in inoperative position does not prevent the weft 3 from entering the shed 9. Specific forms which the weft deflector 13 may take are illustrated in FIGS. 2-5 incl., respectively. Parts which are the same in each of FIGS. 2-5 incl. as those in FIG. 1 are designated by the same reference characters as those employed in FIG. 1.

Figure 2:
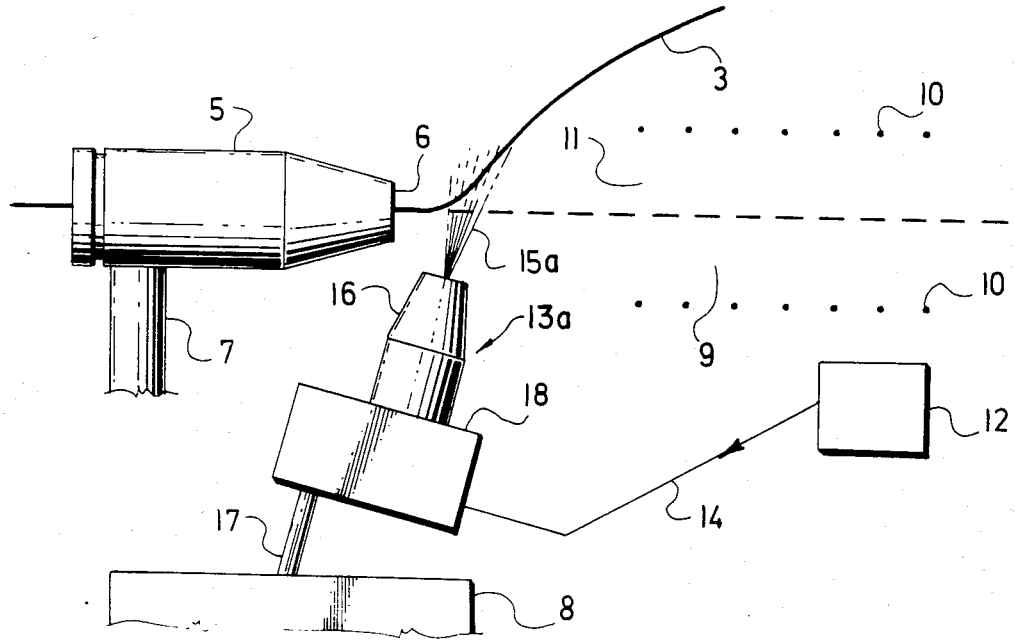
FIG. 2 is a view similar to FIG. 1 but showing a first specific embodiment of the apparatus of the invention.

FIG. 2 illustrates a first specific embodiment 13*a* of the weft deflector 13 which is shown generally in FIG. 1. In the weft deflector 13*a* a deflecting nozzle 16 is mounted below the horizontal weaving plane between the main nozzle 5 and the inlet end or side 11 of the shed. The said deflecting nozzle 16 is connected to a source of pressure fluid 8 by means of an auxiliary supply conduit 17 connected to the pressure source 8, and electromagnetic valve 18 being interposed between the conduit 17 and the deflecting nozzle 16. The electromagnetic valve 18 is controlled though the line 18 by the checking device 12.

Upon detecting a weaving fault by the checking device 12, the checking device imparts a pulse through the electric line 14 to the electromagnetic valve 18 so that the passage of pressure fluid through the deflecting nozzle 16 is made possible by the opening of the valve 18. Downstream of the outlet 6 of the main nozzle 5, within the space of the weft inserting plane, a jet of fluid 15*a* is formed by the deflecting nozzle 16, jet 15*a* thrusting the forward end of the weft 3 upwardly so that after such forward end of the weft passes the jet 15*a* the weft falls and drops upon the woven fabric, thus not being woven into the fabric and being readily removable by being lifted therefrom.

Figure 3:
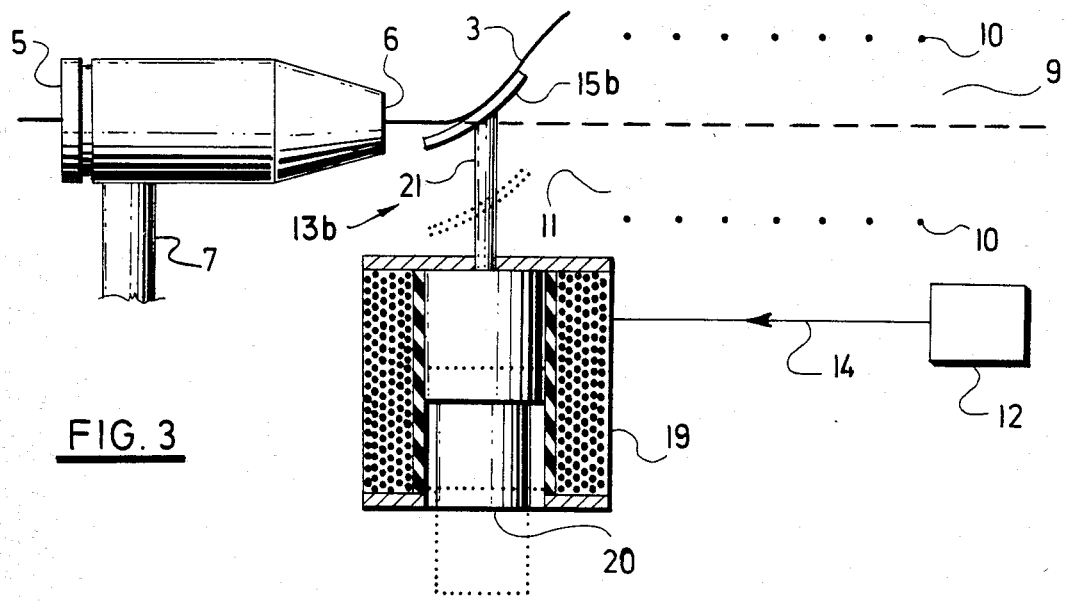
FIG. 3 is a view similar to FIG. 2 of a second specific embodiment of the apparatus of the invention.

In the second specific embodiment 13*b* of the apparatus, shown In FIG. 3, between the main nozzle 5 and the inlet side 11 of the shed there is mounted, below the horizontal weaving plane, an electromagnetic coil or solenoid 19, which is connected by an electric wire 14 to the checking device 12. The plunger 20, which is a circular cross section and is mounted for reciprocation within the coil, is provided at its upper end with a shank 21 upon which a weft stopping means 15*b* is mounted. Member 15*b* has the form of an upwardly concave ramp. When the checking device 12 detects a weaving fault, the electromagnetic coil 19 moves the core 20 upwardly, thereby disposing the means 15*b* in front of the outlet 6 of the main nozzle 5 before the insertion of the next succeeding weft 3. In consequence of such action, such next succeeding weft 3 does not enter the open shed 9, but passes freely above the upper threads 10 of shed 9 by being deflected by the means 15*b*. The thus deflected weft drops upon the fabric in the middle of the loom.

Figure 4:
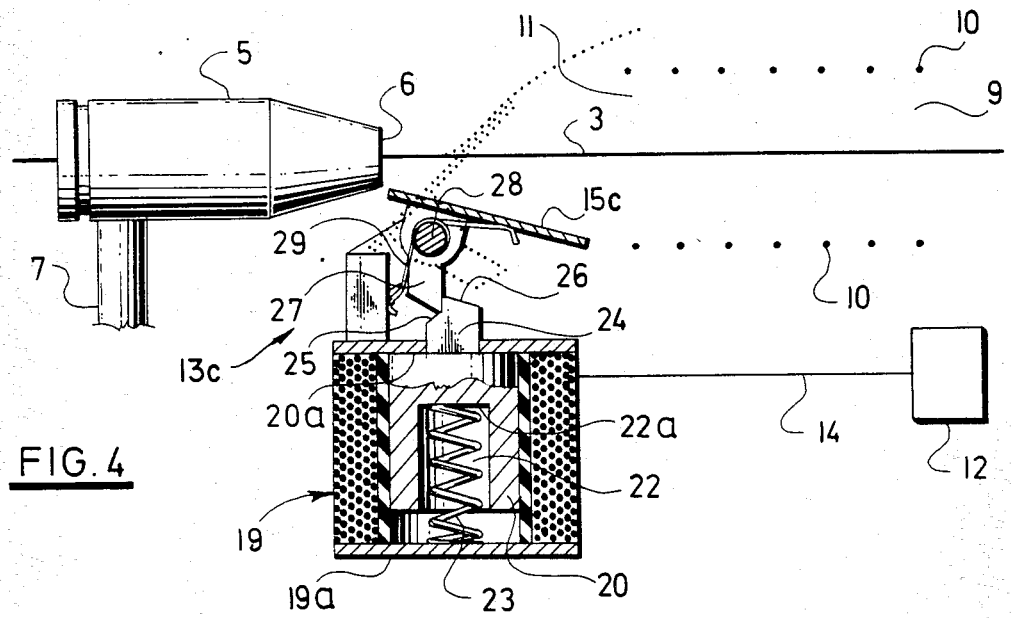
FIG. 4 is a view similar to FIG. 2 of a third specific embodiment of the apparatus of the invention.

In FIG. 4 there is shown a third specific embodiment 13*c* of the apparatus of the invention. In such embodiment an electromagnetic coil 19 is provided at its lower side with a bottom 19*a*, and the core 20 is provided on its lower end with a downwardly open blind bore 22 in which a coil compression spring 23 is located. Spring 23 bears at its bottom end against bottom 19*a* of the electromagnetic coil 19 and the upper end of the spring bears against the closed upper end of the opening 22 in the core. On the closed upper end 20*a* of core 20 there is mounted a finger 24 the upper end of which is provided with a transverse groove 25 and with a chamfer or ramp surface 26. Groove 25 of finger 24 is normally in engagement with a pawl 27 attached to a weft deflecting plate means 15*c*, element 15*c* being swingably mounted on a horizontal pivot pin 28. A coil torque spring 29 is telescoped over the pivot pin 27, spring 29 constantly urging the pawl 27 and the member 15*c* counterclockwise.

By the action of spring 23, core 20 is pressed into engagement with pawl 27, thus holding the weft deflecting plate member 15*c* in the lower, solid line position thereof, shown in FIG. 4. In such lower position member 15*c* does not prevent weft 3 from entering the shed 9. When the checking device 12 detects a weaving fault, current is fed through the wire 14 to the electromagnetic coil 19, which is thus energized and pulls core 20 with its connected finger 24 downwardly, thus releasing pawl 27 and therewith also the weft deflecting member 15*c*. The torque spring 29 then turns the member 15*c* counterclockwise into its phantom line position, so that member 15*c* prevents a further weft 3 from entering shed 9.

Figure 5:
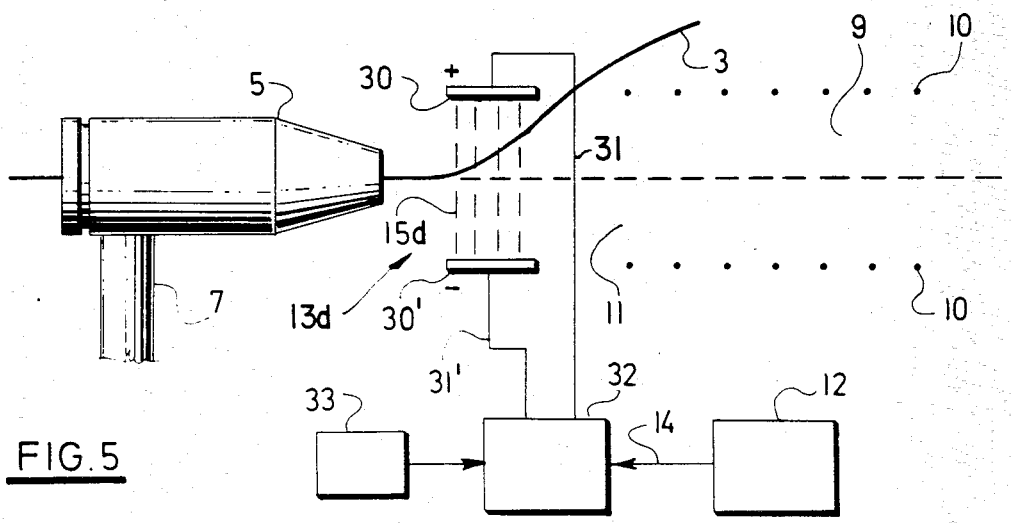
FIG. 5 is a view similar to FIG. 2 of a fourth specific embodiment of the apparatus of the invention.

In FIG. 5 an embodiment 13*d* of the apparatus of the invention is shown in which a pair of electrodes having an electrostatic field between them is used for preventing the weft from entering the shed by deflecting the weft. The weft 3, which is provided with an electrostatic charge by means not shown is fed into the main nozzle 5. Between the main nozzle 5 and the inlet side 11 of the shed there is mounted a pair of electrodes 30, 30′ which are connected by high-voltage lines 31, 31′ to a high-voltage supply 33 through a switch 32. The switch is connected to the checking device 2 by an electrical cable or line 14.

When a weaving fault is detected by the checking device 12, such device emits an electrical pulse which closes switch 32. In this manner, current is supplied to the pair of electrodes 30, 30′ from the high-voltage supply 33 via high-voltage lines 31 and 31′. The thus created electrostatic field between electrodes 30 and 30′ constitutes a weft-diverting means 15*d*, which deflects the electrostatically charged weft 3 from its original direction. The electrostatic charge on the weft 3 may be that which is produced naturally by reason of friction of the weft on the machine components, or artificially by electrodes, an alpha emitter, the ionization of H medium, etc. The negative electrode 30′ can be formed either by the machine frame 1 or another part thereof, and therefore in this case need not be connected to the high-voltage supply 33.

Although the invention is illustrated and described with reference to a plurality of embodiments thereof, it is to be expressly understood that it is in no way limited to the disclosure of such preferred embodiments but is capable of numerous modifications within the scope of the appended claims. Thus although in the illustrative embodiments the invention is shown employed in jet looms, the loom in which the invention is used can employ mechanical means, such as pinch rollers for inserting the weft into the shed, as in the so-called Vincent system. In such system, the repeated insertion of wefts can be stopped by withdrawing the pinch rollers from each other. The weft following the faulty weft is then deflected so as to miss the shed, in accordance with the invention as above described.

We claim:

1. In a loom having a weft supply device, and a shed formed by upper and lower warp threads with an inlet side relative to weft insertion, and means for feeding weft into the shed, the improvement which comprises means disposed between the means for inserting weft and the weft-entering side of the shed for the selective prevention of the feeding of the weft into the shed, said last named means being provided with a starting device, and a checking device, for detecting faulty weaving for controlling said starting device;

wherein the means for the selective prevention of weft insertion into the shed comprises a weft deflecting means formed by a pair of opposed electrodes between which the weft passes, at least one of said electrodes being connected by way of a switch to a high-voltage supply.

2. A loom as claimed in claim 1, wherein the weft deflecting means is formed by an electrostatic field which is created in the space between said pair of electrodes.

* * * * *